United States Patent [19]

Preston et al.

[11] Patent Number: 4,510,949

[45] Date of Patent: Apr. 16, 1985

[54] FEEDING PARTICULATE MATERIAL, ESPECIALLY TOBACCO

[75] Inventors: Edward G. Preston, Orpington, England; David B. Stewart, Dundee, Scotland

[73] Assignee: Molins, PLC, London, England

[21] Appl. No.: 491,334

[22] PCT Filed: Aug. 26, 1982

[86] PCT No.: PCT/GB82/00258

§ 371 Date: Apr. 25, 1983

§ 102(e) Date: Apr. 25, 1983

[87] PCT Pub. No.: WO83/00604

PCT Pub. Date: Mar. 3, 1983

[30] Foreign Application Priority Data

Aug. 26, 1981 [GB] United Kingdom ..... 8126005

[51] Int. Cl.[3] ..... A24C 5/39

[52] U.S. Cl. ..... 131/109 R; 131/108; 19/97; 19/112; 19/114

[58] Field of Search ..... 131/108, 109 R, 109 A, 131/109 AB; 19/97, 112, 114

[56] References Cited

U.S. PATENT DOCUMENTS

| | | | |
|---|---|---|---|
| 485,272 | 11/1892 | Groom | 19/97 |
| 1,630,158 | 5/1927 | Allen | 19/114 |
| 3,196,880 | 7/1965 | Pinkham | 131/109 R |
| 3,996,943 | 12/1976 | Hinzmann | 131/109 R |
| 3,996,944 | 12/1976 | Hinzmann | 131/109 R |

FOREIGN PATENT DOCUMENTS

| | | | |
|---|---|---|---|
| 0300970 | 6/1916 | Fed. Rep. of Germany | 19/97 |
| 1023764 | 12/1952 | France | 19/97 |
| 1528343 | 6/1966 | France | 19/114 |

*Primary Examiner*—V. Millin

*Attorney, Agent, or Firm*—Antonelli, Terry & Wands

[57] ABSTRACT

A cigarette making machine or feed apparatus for fibrous material other than tobacco includes a pinned conveyor (20) arranged to feed material from a supply and past refusing means (22) whereby the feed conveyor will carry a metered stream of the material, characterized in that the feed conveyor has relatively high pins (36) which are substantially evenly distributed among relatively low pins (38) or lie in obliquely extending rows (34, 40, 42, 44) between rows of relatively low pins.

11 Claims, 5 Drawing Figures

FEEDING PARTICULATE MATERIAL, ESPECIALLY TOBACCO

This invention is particularly concerned with feeding tobacco, especially in a cigarette making machine, but it is more generally concerned with feeding particulate material for any purpose. In this connection the expression "particulate material" is intended to include fibers used in the textile industry, as well as material such as cut tobacco.

A cigarette making machine commonly includes a pinned feed roller which partly defines a space into which tobacco is fed and from which the roller is arranged to pick up tobacco in order to feed a metered stream of tobacco towards a part of the machine in which the tobacco is formed into a cigarette filler stream. A second pinned roller (termed a "refuser roller") is set close to the feed roller so that the envelope containing the points of the pins on the refuser roller is slightly spaced from the envelope of the pin points on the feed roller. The refuser roller thus brushes back excess tobacco which would otherwise be carried forward by the feed roller, thus ensuring that the feed roller carries a substantially metered stream of tobacco to be formed into a cigarette filler stream.

According to the present invention, the feed roller or other feed conveyor of an apparatus for feeding a metered stream of tobacco or other fibrous material has relatively high pins (i.e., extending further towards the refusing means) which are substantially evenly distributed among relatively low pins or lie in obliquely extending rows between rows of relatively low pins.

This invention reduces the tendency for the tobacco or other material to be broken during the metering process.

In one preferred arrangement the pins on the feed roller lie in rows extending axially and circumferentially with respect to the roller, alternate pins in each axially-extending row being high and low, and likewise in each circumferentially-extending row. Thus the high pins lie in helically-extending rows between which there are similar helically extending rows of low pins; and the high pins are also evenly distributed.

Alternatively, the high pins may lie in broad helically-extending bands, each band being generally formed by a number of parallel helically-extending rows of pins, and the remainder of the pins being relatively low. There may, for example, be helically-extending bands inclined in opposite senses so as to form a herring-bone pattern.

It is important that the high pins should be evenly distributed and/or lie in helical rows (or oblique rows in the case of a band conveyor). If, for example, the feed roller had non-helical bands (i.e. multiple rows) of high pins alternating with bands of low pins, the total tobacco feed rate would fluctuate cyclically.

All the pins are preferably inclined to the surface of the feed roller by the same angle, for example 40 degrees; that is to say, the angle between the axis of each pin and a tangent to the drum at the root of the pin is 40 degrees. The tips of the high and low pins may respectively lie at distances of 6.7 mm and 4.7 mm from the surface of the roller; in general, the height of the high pins is preferably at least 30% greater than that of the low pins.

Feed rollers used in cigarette making machines commonly have pins. However, especially in the case of feeds for materials other than tobacco, it is possible to use carding in the form of pointed parts which are not strictly pins; such pointed parts are intended to be included in references to "pins" in this context.

Examples of cigarette making machines according to this invention are shown in the accompanying drawings. In these drawings.

Figure 1:
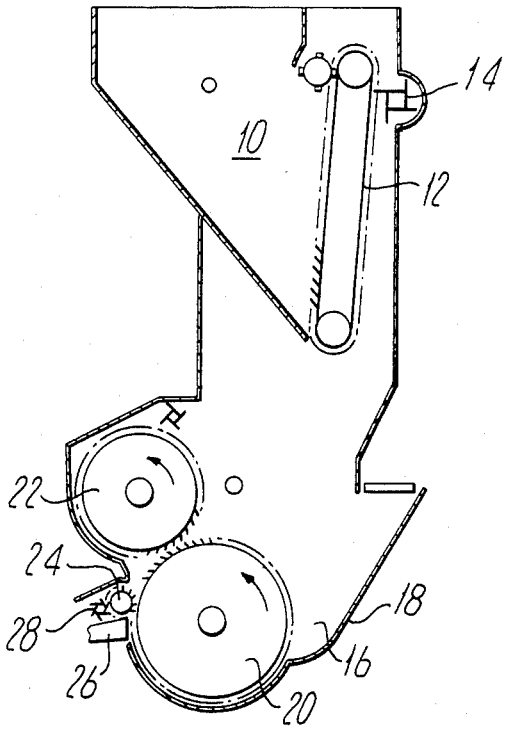
FIG. 1 is a diagrammatic view of part of a cigarette making machine in the direction of the axis of the feed roller.

FIG. 1 shows the main components of the hopper of a cigarette making machine. A hopper of this type is included in the Molins MK9 cigarette making machine. Further details of the hopper may correspond to those commonly used in the MK9 Machine. Alternatively, the hopper may be in the general form shown in British patent specification No. 909,222, which corresponds generally to the Molins Mark 8 cigarette making machine.

FIG. 1 shows firstly a hopper space 10 into which tobacco is to be delivered from time to time. A pinned elevator band 12 carries a stream of tobacco from the space 10, and this tobacco is removed from the elevator with the assistance of an unravelling roller 14, whereupon the tobacco drops into a space 16. This space 16 is defined partly by a fixed plate 18 and partly by a feed roller 20.

A refuser roller 22 brushes back excess tobacco which would otherwise be carried past it by the feed roller 20, and the metered tobacco stream is removed from the roller 20 by a picker roller 24 rotating in a clockwise direction so as to project the tobacco along a plate 26. An accelerator roller 28 accelerates the tobacco along the plate 26 towards a region of the machine in which the tobacco is showered towards a tobacco band to form a cigarette filler stream.

Figure 2:
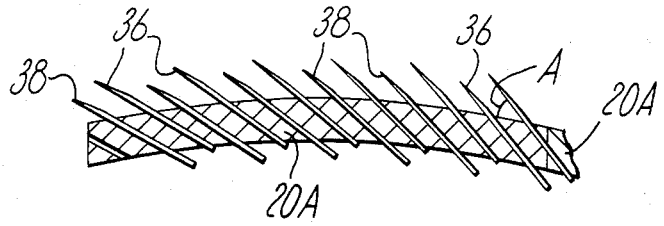
FIG. 2 is a view on an enlarged scale of part of the feed roller.
Figure 3:
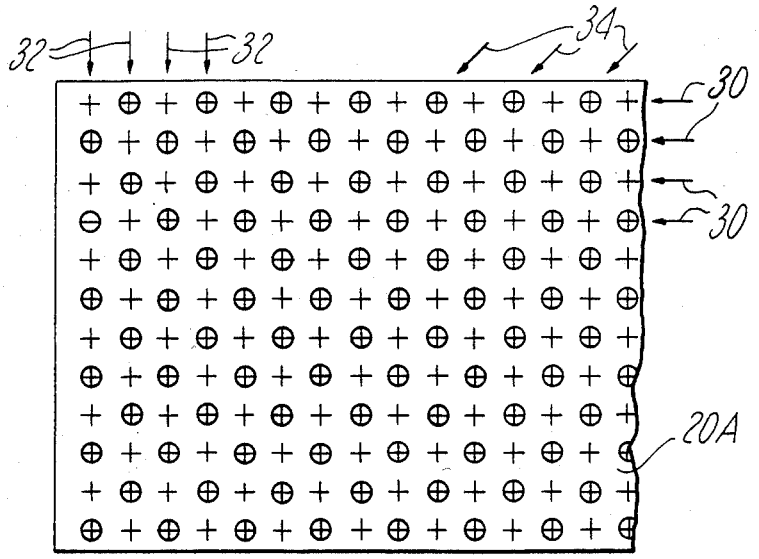
FIG. 3 is a flat-developed view of part of the surface of the feed roller on the same scale as FIG. 2.

The periphery of the feed roller 20 is formed by fourteen staves 20A. An end view of one complete stave is shown in FIG. 2. FIG. 3 is a flat developed view of an end portion of one stave.

As shown particularly in FIG. 3, the pins lie in orthogonal axial and circumferential rows in the direction of the arrows 30 and 32 respectively. The centers of the pins at their roots are indicated by crosses. High pins lie at positions having additional circles around the crosses. Thus the high pins lie in helical rows extending in the direction of arrows 34. Between those rows there are similar helical rows of low pins.

It should be noted that each axial row 30 and each circumferential row 32 consists of alternate high and low pins, as shown also in FIG. 2 in relation to a circumferential row.

In FIG. 2 the high pins are identified by the reference numeral 36, and the low pins by the reference numeral 38. It should be noted that the pins are in fact all of the same length and are simply arranged to project from the surface of the roller by varying distances. Each pin may be a sliding fit in the corresponding hole which is drilled to receive it, and may be secured in position by an appropriate adhesive, e.g. as described in British patent specification No. 1,298,561.

The pins are all inclined by the same angle A to the surface of the roller, that angle being 40 degrees.

By way of example, the pins in both the axial rows 30 and the circumferential rows 32 may be at intervals of $\frac{1}{4}$ inch (6.35 mm). The pins on the refuser roller may be set at smaller intervals. It should be noted that the envelope containing the points of the pins of the refuser roller is slightly spaced (for example, by 0.3 to 0.4 mm) from the envelope containing the points of the high pins on the feed roller.

Figure 4:
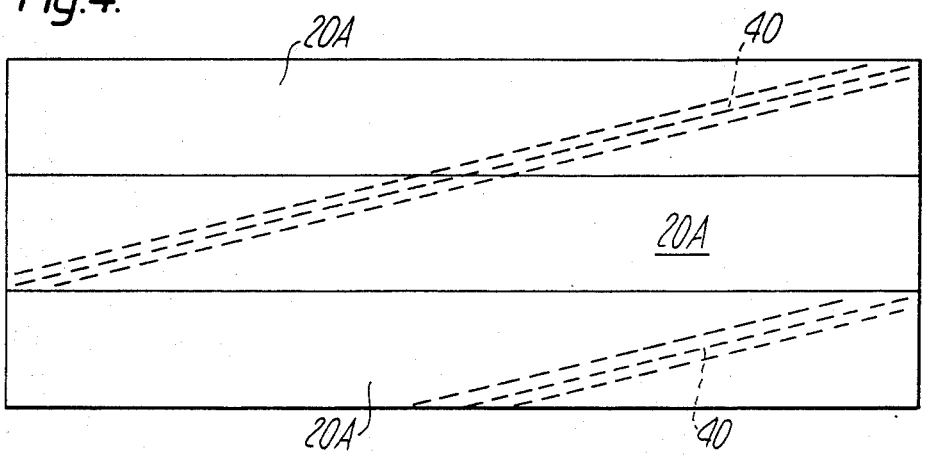
FIG. 4 is a flat-developed view of part of the surface of an alternative feed roller.

FIG. 4 is a flat developed view of three staves of an alternative feed roller. The pins in this example again lie in axially and circumferentially extending rows as shown in FIG. 3. However, the high pins in this example lie generally in helically extending bands 40 each formed by three substantially parallel rows of high pins lying generally along the three dotted lines shown in FIG. 4. Because the pins are at fixed axial and circumferential intervals, they cannot lie exactly in straight lines as shown in FIG. 4, but they are arranged to be as close to those lines as possible.

It should be noted that each band of high pins 40 in FIG. 4 starts at one corner of one stave 20A and terminates at the far corner of the next adjacent stave at the opposite end of the roller. As an alternative, each helical band may extend between diagonally opposite corners of the same stave, or may extend over three or more staves.

It will be appreciated that the pins lying in areas between the bands 40 are relatively low pins. They may all be of equal height; alternatively their heights may vary.

Figure 5:
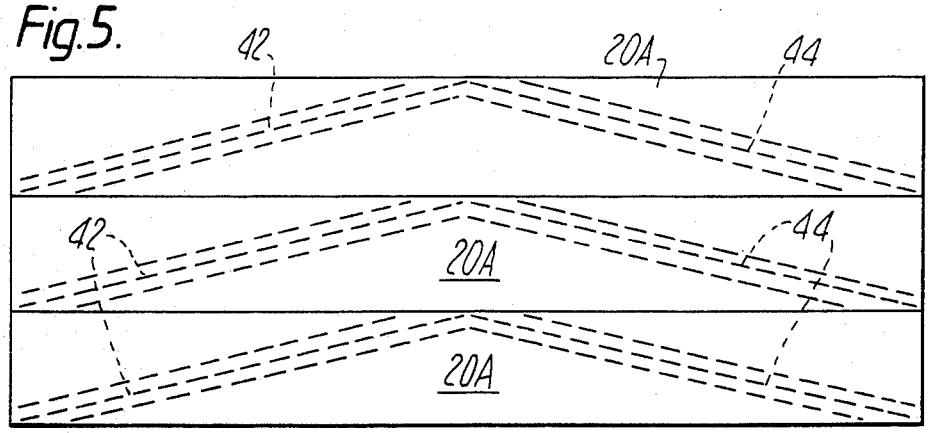
FIG. 5 is a flat-developed view of part of the surface of another alternative feed roller.

FIG. 5 shows an alternative construction in which each stave 20A of the feed roller has one band 42 of high pins extending helically at one inclination, and a second band 44 which is oppositely inclined so that the two sets of bands together form a herring-bone pattern.

It will be appreciated that each of the bands 40, 42 and 44 in FIGS. 4 and 5 may be formed by a different number of rows of high pins, for example two rows or four or more rows.

Other arrangements with bands of pins are possible, provided the number of high pins lying in any axial line along the surface of the carded drum is substantially constant at various positions around the roller. For example, in FIG. 3 each row 30 and/or each row 32 may include two or possibly more short pins between successive long pins. Another possibility is that single rows of long pins set at a helix angle of 45 degrees (like the rows 34 in FIG. 3) may alternate with, for example, double rows of short pins, or there may similarly be two rows of long pins between successive single helical rows of short pins.

We claim:

1. Apparatus for feeding a metered stream of tobacco or other particulate or fibrous material, including a pinned feed roller having forwardly inclined pins and arranged to feed material from a supply and past a pinned refuser roller whereby the feed roller will convey a metered stream of the material, the pins of the feed roller comprising relatively high pins which are substantially evenly distributed among relatively low pins.

2. Apparatus according to claim 1, the envelope containing the points of the pins on the refuser roller being slightly spaced from the envelope containing the points of the high pins on the feed roller.

3. A cigarette making machine according to claim 2, in which the pins on the feed roller lie in rows extending axially and circumferentially with respect to the roller, alternate pins in each axially-extending row being high and low, and likewise in each circumferentially-extending row.

4. A cigarette making machine according to claim 2, in which the high pins lie in broad helically-extending bands, each band being generally formed by a number of parallel helically-extending rows of pins, and the remainder of the pins being relatively low.

5. A cigarette making machine according to claim 4, in which helically-extending bands are inclined in opposite senses so as to form a herring-bone pattern.

6. A cigarette making machine according to claim 1, in which all the pins on the feed roller are inclined to the surface of the roller by the same angle.

7. A cigarette making machine according to claim 6, in which the angle of inclination of each pin to the surface of the feed roller is approximately 40 degrees.

8. A cigarette making machine according to any one of claims 3 to 7, in which the high pins have a height which is at least 30% greater than that of the low pins.

9. A cigarette making machine according to claim 8, in which the feed roller is arranged to convey tobacco upwards from a space between the feed roller and a fixed wall.

10. Apparatus for feeding a metered stream of tobacco or other particulate or fibrous material, including a pinned feed roller having forwardly inclined pins and arranged to feed material from a supply and past a pinned refuser roller whereby the feed roller will convey a metered stream of the material, the pins of the feed roller comprising relatively high pins which lie in obliquely extending rows between rows of relatively low pins.

11. Apparatus for feeding a metered stream of particulate material, including a pinned feed roller having forwardly inclined pins and arranged to feed material from a supply and past a pinned refuser roller whereby the feed roller will convey a metered stream of the material, the pins of the feed roller comprising relatively high pins which lie in obliquely extending rows between rows of relatively low pins.

* * * * *